United States Patent [19]

Dyment et al.

[11] Patent Number: 4,794,764

[45] Date of Patent: Jan. 3, 1989

[54] ARTICLE DISPLAY APPARATUS

[75] Inventors: James A. Dyment, New Richmond; Harvey W. Benison, Cincinnati; Karl E. Haschart, Cincinnati; John S. Veach, Cincinnati, all of Ohio

[73] Assignee: Dyment Limited, Ontario, Canada

[21] Appl. No.: 11,206

[22] Filed: Feb. 5, 1987

Related U.S. Application Data

[63] Continuation-in-part of Ser. No. 764,989, Aug. 12, 1985, Pat. No. 4,663,943.

[51] Int. Cl.[4] ..... A47F 3/04

[52] U.S. Cl. ..... 62/250; 62/378; 62/381; 221/278

[58] Field of Search ..... 221/82, 150 R, 155, 221/298; 62/250, 248, 297, 381, 378, 246–256; 312/36

[56] References Cited

U.S. PATENT DOCUMENTS

| | | | |
|---|---|---|---|
| 1,719,146 | 7/1929 | Stringer . | |
| 1,883,961 | 10/1932 | Kosmerl | 62/252 X |
| 1,905,180 | 4/1933 | Lowther | 221/82 X |
| 1,923,032 | 8/1933 | Frick et al. | 221/82 |
| 1,934,133 | 11/1933 | Lauderback . | |
| 2,013,901 | 9/1935 | Shankland . | |
| 2,176,823 | 10/1939 | Richardson . | |
| 2,298,790 | 10/1942 | Klassen | 62/254 X |
| 2,435,177 | 1/1948 | Connell et al. | 62/381 X |
| 2,463,658 | 3/1949 | Thrasher | 62/252 X |
| 2,474,452 | 6/1949 | Amyot | 62/249 |
| 2,477,393 | 7/1949 | Skoog et al. | 62/252 |
| 2,647,029 | 7/1953 | Deland | 221/155 X |
| 2,672,735 | 3/1954 | Fusselman . | |
| 2,706,387 | 4/1955 | Swanson . | |
| 2,791,889 | 4/1957 | Childers | 62/381 |
| 2,986,019 | 5/1961 | Happer | 62/250 |
| 3,025,681 | 3/1962 | Booth | 62/248 |
| 3,115,019 | 12/1963 | Rutishauser | 62/256 |
| 3,179,289 | 4/1965 | Moyer et al. | 221/121 |
| 3,306,068 | 2/1967 | Allgeyer et al. | 62/256 |
| 3,365,907 | 1/1968 | Barroero | 62/256 |
| 3,410,385 | 11/1968 | Freet et al. | 194/39 |
| 3,462,966 | 8/1969 | Reid et al. | 62/248 |
| 3,552,138 | 1/1971 | Davis | 62/249 |
| 3,627,395 | 12/1971 | Hoey | 312/125 |
| 3,712,507 | 1/1973 | Holt | 221/82 |
| 3,769,805 | 11/1973 | Corini | 62/3 |
| 4,085,986 | 4/1978 | Taub | 62/255 X |
| 4,267,706 | 5/1981 | Abraham | 62/256 |
| 4,314,458 | 2/1982 | Hade et al. | 62/256 |
| 4,373,355 | 2/1983 | Monroe | 62/256 |
| 4,449,761 | 5/1984 | Davis et al. | 312/116 |

*Primary Examiner*—Lloyd L. King

*Attorney, Agent, or Firm*—Wood, Herron & Evans

[57] ABSTRACT

A portable article display apparatus for displaying articles such as beverage cans or other items includes a hollow housing having a transparent outer wall, a base support for mounting the housing and a door mounted over an access opening in the transparent outer wall for removing articles one-by-one from the housing. Systems for cooling the housing interior and defogging its transparent outer wall are provided for displaying food articles or other items which must be refrigerated. Articles are stacked in vertical columns within the housing interior upon an article support carriage which is rotatable with respect to the fixed base and housing to index each vertical column of articles into direct alignment with the door. In removing articles from the housing, the door is operable in an open position to permit removal of the lowermost article in the column while supporting the articles above. The remaining articles in the column are released in preparation for removal of another article upon closing the door.

16 Claims, 8 Drawing Sheets

ARTICLE DISPLAY APPARATUS

RELATED CASES

This application is a continuation-in-part of U.S. patent application Ser. No. 764,989, filed Aug. 12, 1985 and entitled "Article Display Apparatus", now U.S. Pat. No. 4,663,943.

BACKGROUND OF THE INVENTION

This invention relates to an article display apparatus, and more particularly to a portable display unit for dispensing articles such as beverage cans in which the articles are stacked in vertical columns within a transparent housing.

The marketing concept commonly known as "impulse" buying has been effectively used in a variety of retail establishments, including supermarkets and convenience food stores. The idea behind impulse buying is that customers must see certain products before they are motivated to buy. In order to promote impulse buying, such products should be displayed attractively and at a location in the store which most customers are likely to pass by.

One aspect of impulse buying, particularly for food products requiring refrigeration, has been the development of article displays having transparent doors or walls with shelves angled upwardly from front to back so that all articles on the shelves may be seen by customers. Refrigerated display devices most commonly in use today are typically wall-mounted units having clear glass doors which open to an interior provided with a number of angled shelves adapted to support product.

Permanent well-mounted article display devices of the type described above present several limitations from the standpoint of promoting effective impulse buying. Only the front panel or door of such display devices is clear and thus the product it contains can only be viewed from one direction. In addition, such units are essentially permanently mounted to a wall or the floor and are not portable to various locations around the store. Items such as soft drinks, wine, prepared sandwiches and the like might sell much more quickly if the display apparatus could be moved to a location near the checkout counters of a store or other areas of high customer traffic. Marketing with impulse buying is effective only when the customer views the product, and permanently mounted wall units often are located in areas of low customer traffic.

Portable, refrigerated display devices have been proposed to promote impulse buying of food items, as an alternative to wall-mounted displays. Portable, refrigerated displays generally include a clear housing mounted atop a base having rollers for movement of the display to the desired location. The housing includes a plurality of spaced shelves which are accessible by opening a single door mounted to the housing. Display devices of this type permit 360° viewing of the articles placed therein and are portable.

Portable devices of the type described above provide an improvement over wall-mounted units from the standpoint of impulse buying, but also have limitations. The large access door mounted to the housings of such portable displays must be swung outwardly for removal of articles from the interior. This limits where the display may be positioned because the large door could interfere with customer traffic if it is opened into an aisle, or contact a counter or display. Additionally, large access openings allow extensive amounts of ambient air to enter and warm the interiors of such portable displays. As a result, the refrigeration units for such displays must cycle on frequently, and the clear, glass walls of their housings can become fogged with condensed moisture.

SUMMARY OF THE INVENTION

It is therefore among the objectives of this invention to provide a portable display apparatus for dispensing articles such as beverage cans which is compact but capable of displaying a relatively large quantity of articles in a small area, which can be positioned in virtually any location in a store without interfering with customer traffic while removing articles therefrom, and which can be adapted for efficiently and economically refrigerating food articles.

These objectives are accomplished in a portable article display apparatus comprising a base support, a cylindrical housing having at least one transparent outer, annular wall defining a hollow interior, door means mounted to the housing having a compact door panel to permit access to the housing interior for removal of articles one-by-one therefrom, and, in one presently preferred embodiment, means for cooling the housing interior and defogging the transparent outer wall of the housing. Articles are stacked in vertical columns within the housing interior upon an article support carriage rotatably mounted to the base support beneath the housing. The article support carriage is rotatable with respect to the fixed base support and housing to index each vertical column of articles into alignment with the door panel and thereby place the articles in each column in a position for removal one-by-one from the housing interior.

More specifically, in one aspect of this invention, a display apparatus is provided for dispensing articles such as beverage cans, oil cans, cigarette packs or any other product which can be stacked end-to-end in a vertical column. In one embodiment, the display apparatus includes a housing formed with a single transparent, cylindrical outer wall, a top cover and an open bottom. Alternatively, the housing is formed with two concentric cylindrical walls with an air space therebetween. A support column connected to a base is received within the hollow interior and mounted to the top cover of the housing.

Articles are stacked end-to-end in a plurality of vertical columns within the housing atop an article support carriage which is rotatably mounted to the support column at the open bottom of the housing. The article support carriage includes a wooden or plastic base plate supported on a lazy-susan-type bearing which is mounted to the column such that the article support carriage, and the vertical columns of articles it supports, are rotatable with respect to the fixed housing and column. Preferably, an elastomeric ring is mounted to the bottom of the housing which rests atop the base plate of the article support carriage to provide a dynamic seal therebetween as the article support carriage is rotated.

Articles, such as beverage cans, are mounted atop the article support carriage by a plurality of spaced article supports in the form of vertically-extending spacers or fins carried by a cylindrical wall mounted atop the article support carriage. The fins are spaced apart and shaped so that adjacent fins form an elongated sleeve in which articles, such as beverage cans, are retained in vertical columns atop the article support carriage. In one presently preferred embodiment, the fins are formed of a thermally-conductive material to aid in cooling of articles which must be refrigerated as described in more detail below.

A locator member is provided within the housing interior to index the article support carriage so that each vertical column of articles is aligned with the door panel mounted across an access opening formed in the outer wall of the housing. The article support carriage is rotated by grasping a ring mounted to the article support carriage beneath the housing so tha the desired vertical column may be indexed in place at the door panel for removal of the articles one-by-one.

In one presently preferred embodiment of this invention, one or more product-mounting pins, hooks or the like are connected to the column between its base and the housing. Alternatively, a basket is rotatably mounted to the column which rests atop the base. It is contemplated that the support pins, hooks or basket could be utilized to store and display various novelty items or snack food items, such as potato chips, corn chips, candy bars, etc.

In another aspect of this invention, a door assembly is provided which includes a door panel covering the access opening in the transparent outer wall of the housing. The door assembly includes structure responsive to movement of the door panel to an open position which tilts the lowermost article outwardly toward the access opening in the housing for removal therefrom and at the same time clamps the article immediately above the lowermost article to retain the remaining articles in position in the vertical column. When the door panel is then moved to a closed position, with the lowermost article having been removed, the remaining articles in the vertical column are released so that the next article in the column rests atop the article support carriage in a position for removal from the housing interior.

More specifically, the door assembly of this invention cooperates with a plurality of pivotal article support members, each of which are mounted to the article support carriage for supporting a vertical column of articles. The article support members are movable between an article support position beneath the vertical column of articles, and an article discharge position in which the lowermost article in the column is tilted forwardly for removal from the housing. Pusher means associated with the door assembly is operable in response to movement of the door panel to an open position to contact and pivot the article support member to an article discharge position, and then disengage the article support member when the door panel is closed to return the article support member to an article support position.

The door assembly also includes column support means which is operable in response to opening of the door panel to engage the article immediately above the lowermost article in the column and clamp it in place so that the remaining articles in the column are maintained in position while the lowermost article is removed from the housing. When the door panel is closed, the column support means releases the remaining articles in the column onto the article support member.

The door assembly of this invention provides several advantages. The door panel is relatively small and swings upwardly when opened so that the article display apparatus herein may be positioned in virtually any location around the store, office or other location without interfering with customer traffic. In opening the door panel to remove an article, the article is tilted forwardly for easy access by the consumer without being tipped over onto the floor. In addition, the articles in the vertical column above the lowermost article are positively held in place and not released until the door panel is almost closed, thus preventing a child from getting his or her fingers caught beneath the column of articles after they are released.

In another aspect of this invention, a cooling system is provided for cooling the interior of the housing in order to refrigerate food items such as beverage cans and the like. The portion of the support column contained in the interior of the housing is hollow and forms an air passageway having inlets near the bottom of the housing and outlets near the top of the housing. A cooling coil, preferably in the form of copper tubing, is coiled within the column between its inlet and outlet openings. The cooling coil and column are disposed within the cylindrical wall which carries the spaced fins used to retain the articles in vertical columns within the housing.

Cooling fluid in liquid phase is pumped from a compressor carried in the base to the bottom of the cooling coil located near the inlet openings in the column. The cooling fluid is converted to gaseous phase thereat and circulated through the cooling coil toward the top of the housing. The temperature of the cooling coil and column to which it is mounted are maintained at between about 32°–40° F., with the temperature of the coil and column nearer the top of the housing being somewhat higher than the temperature of the coil and column at the base of the housing. This temperature differential in the cooling coil and column is due to the gradual warming of the cooling fluid as it moves upwardly through the coil.

A blower is mounted in the upper end of the column near the top of the housing which is operable to draw air into the hollow interior or passageway of the column through the air inlet openings at the bottom of the housing and then out the air outlet openings near the top of the housing where it is discharged over the articles held in the spaced fins. This is an improvement over prior art systems where the air flow is in the opposite direction, that is, from the cooler portion of the coil toward the warmer portion of the coil. In the relatively compact space within which the articles are stacked in the housing herein, it was found that a cooling air flow directed upwardly from the cooler portion of the coil at the bottom of the housing to the warmer portion of the coil at the top, in accordance with prior art teachings, caused the articles at the bottom of the housing to freeze and those at the top to remain relatively warm.. By circulating the air from top to bottom in this invention, the temperature of the articles within each column is maintained nearly uniform. Additionally, the thermally conductive fins become uniformly chilled which also helps maintain each article in the column at substantially the saem temperature.

In still another aspect of this invention, one presently preferred embodiment includes a system for defogging the transparent outer wall of the housing. The base of the support column is formed with a vent, preferably stamped in a stylized configuration such as a logo or the like, for the receipt of outside ambient air therethrough. The ambient air is drawn over the motor and compressor which heats the ambient air at least to some degree.

A number of outlet openings are formed in the column beneath the housing which communicate with a conical-shaped flow control plate having an upright outer lip. The flow control plate is mounted to the column beneath the housing and extends radially outwardly from the column such that its outer lip is substantially parallel to and spaced from the transparent outer wall of the housing. Air drawn through the vent in the base of the column flows upwardly through the column and out the outlet openings to the flow control plate. The flow control plate is operable to direct the heated air along the exterior surface of the transparent outer wall of the housing to prevent condensation of moisture thereon.

DESCRIPTION OF THE DRAWINGS

The structure, operation and advantages of this invention will become further apparent upon consideration of the following description taken in conjunction with the accompanying illustrative drawings, wherein.

DETAILED DESCRIPTION OF THE INVENTION

Figure 1:
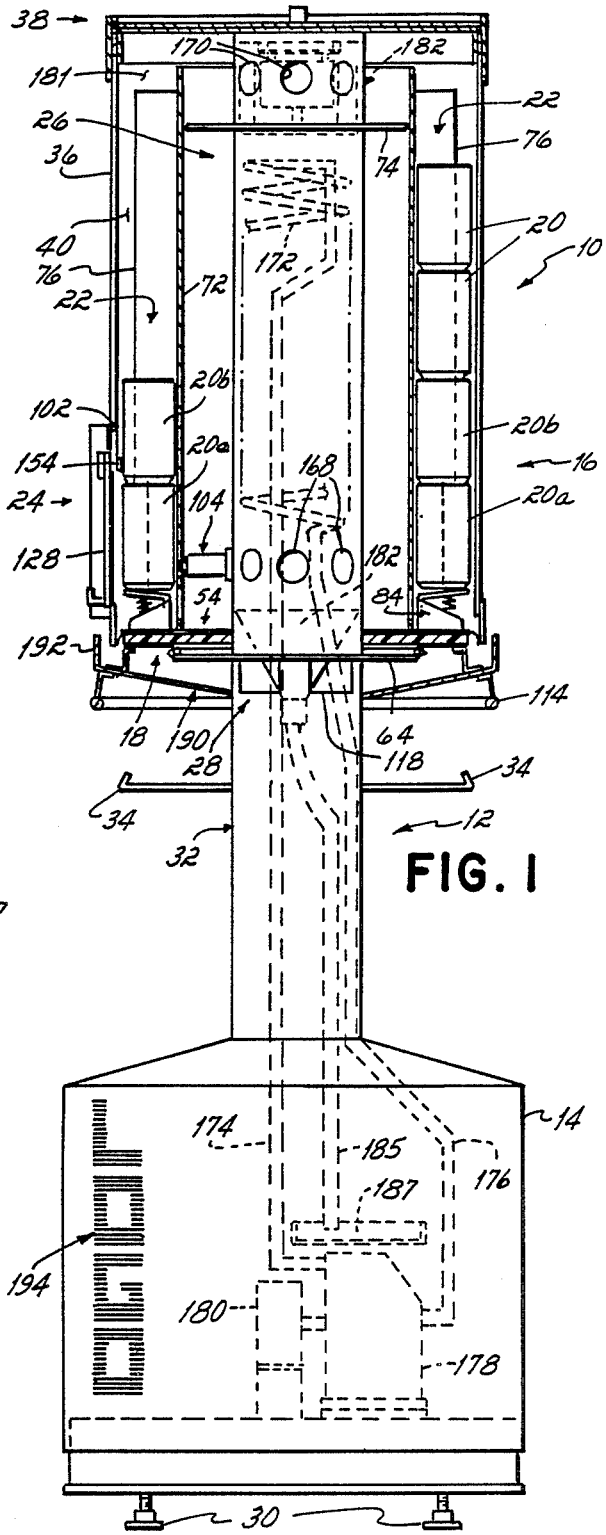
FIG. 1 is a side view in partial cross section of the article display apparatus of this invention.
Figure 2:
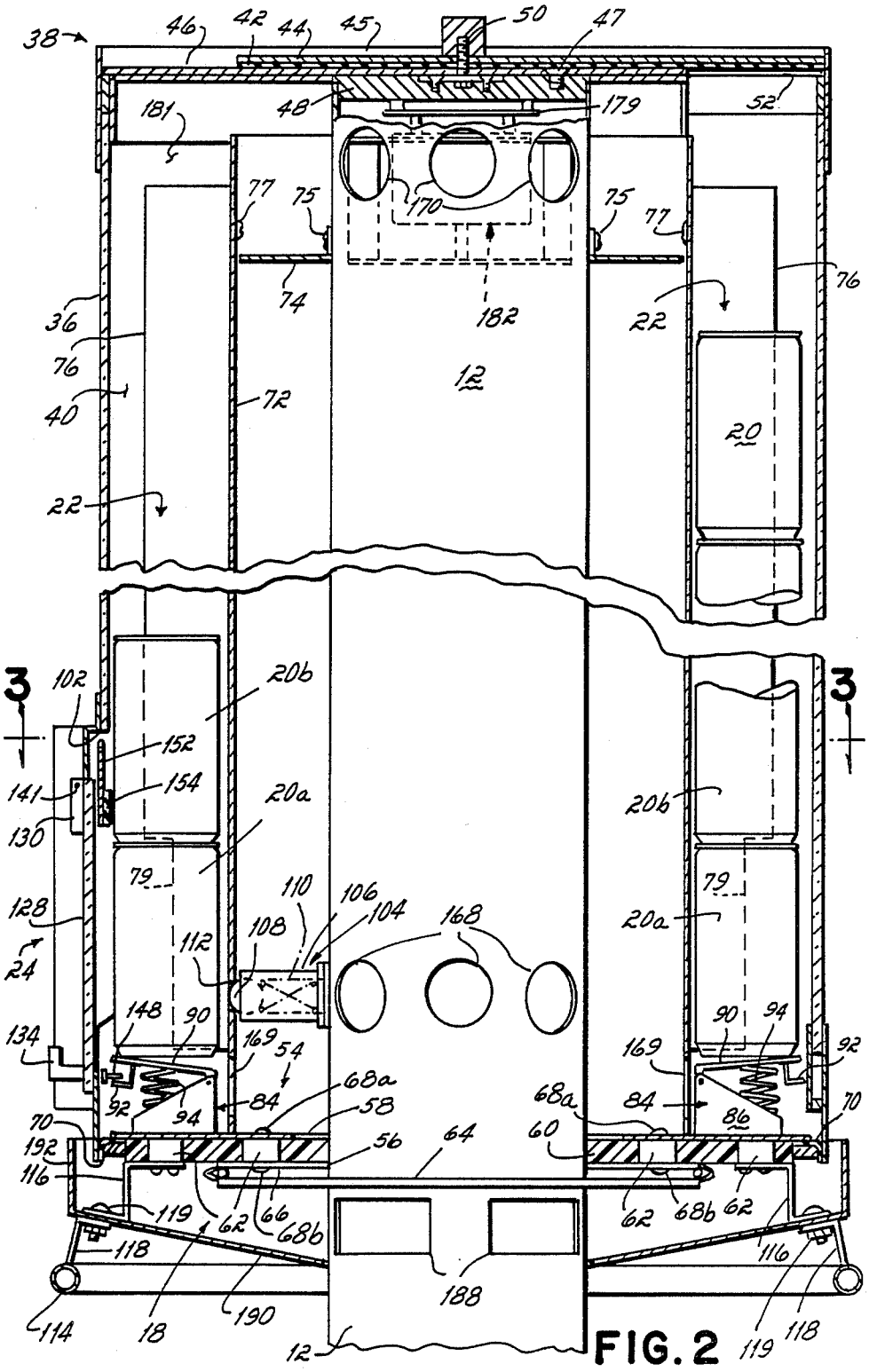
FIG. 2 is an enlarged, partial cut-away side view of the top portion of the display apparatus shown in FIG. 1.

Referring now to FIGS. 1 and 2, one embodiment of the article display apparatus 10 of this invention includes a column 12 having a base 14, a cylindrical housing 16 mounted atop the column 12 and an article support carriage 18 rotatably mounted to the column 12 beneath the housing 16. A plurality of articles 20 such as soda cans are stacked end-to-end in vertical columns 22 atop the article support carriage 18. The article support carriage 18 is rotatable with respect to the fixed column 12 and housing 16 to index each of the vertical columns 22 into alignment with a door assembly 24 mounted to the housing 16 for removal of the articles 20 therefrom. In the embodiment of display apparatus 10 illustrated in FIG. 1, a refrigeration system 26 is provided to maintain the articles 20 cool, and a defogging system 28 prevents condensation of moisture along the exterior of housing 16.

More specifically, the base 14 is hollow and could be formed of metal, plastic, concrete or a similar material. The column 12 is preferably formed of a thermally conductive material in a continuous section or multiple sections connected together, and includes a thermal break (not shown) to limit condensation along its exterior from the refrigerated housing 16. The base 14 is supported on the floor by spaced pads 30, although it is contemplated that other supports such as rollers could be utilized.

In one presently preferred embodiment shown in FIG. 1, the middle portion 32 of the column 12, between the housing 16 and base 14, is provided with one or more hooks 34 which are adapted to support articles such as bags of snacks and the like, housewares, toiletries, and other articles.

Figure 7:
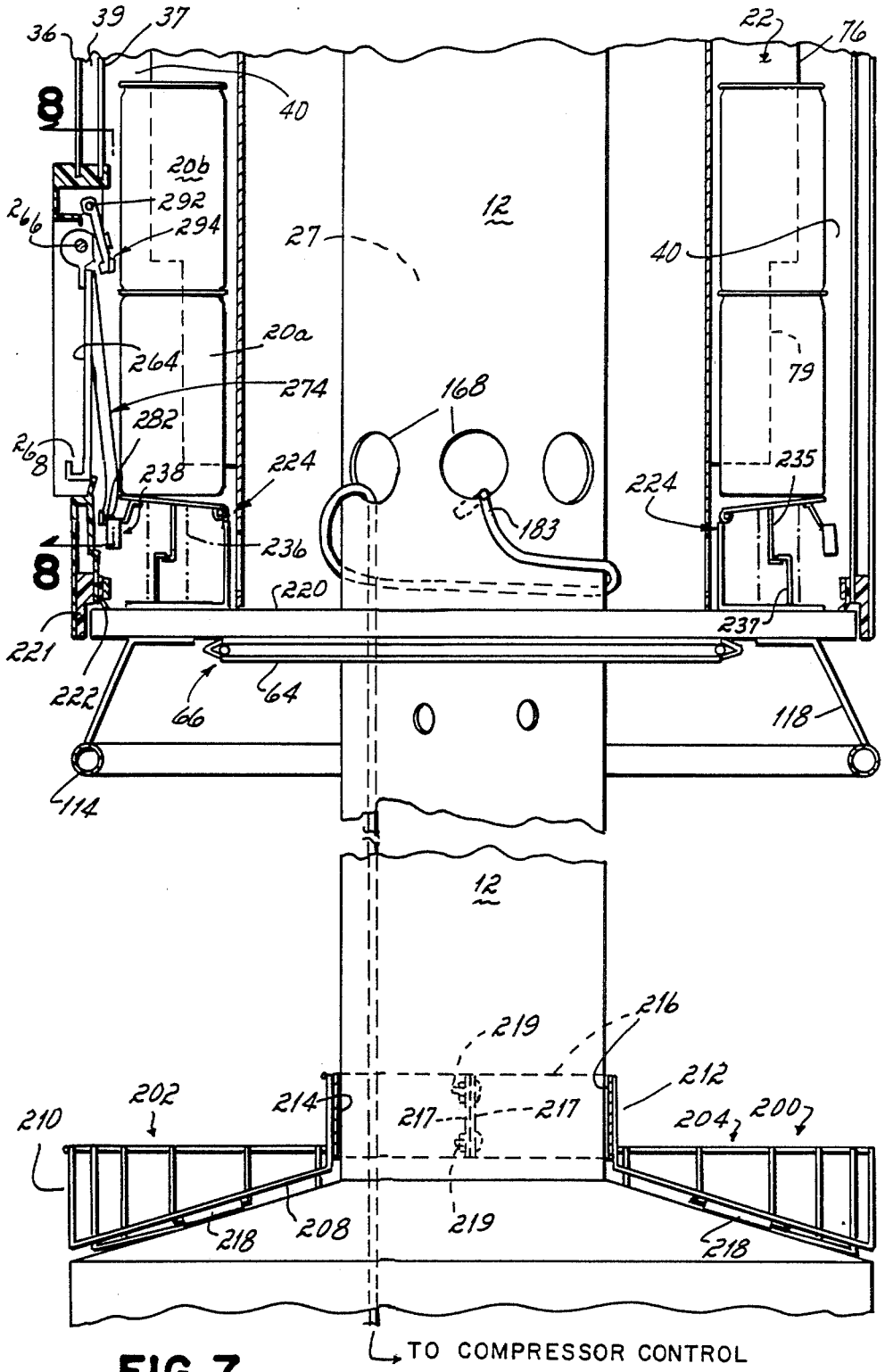
FIG. 7 is an enlarged, partial side elevational view of the top portion of an alternative embodiment of the display apparatus herein.
Figure 13:
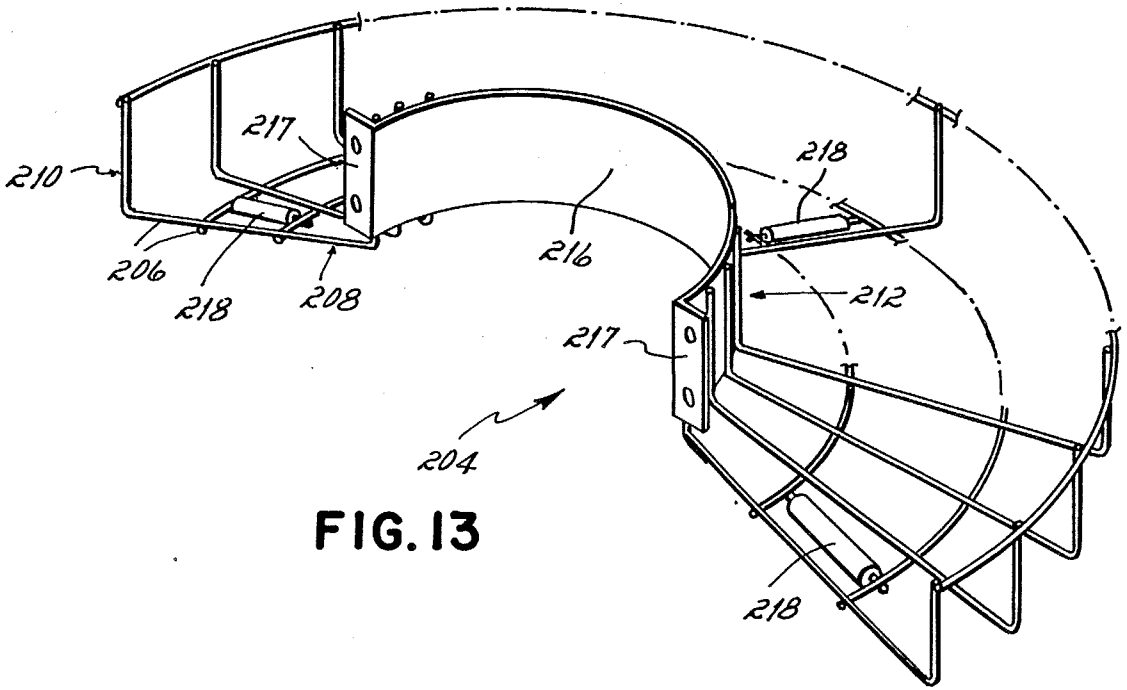
FIG. 13 is an enlarged, isometric view of one-half of a basket mounted to the base of the display apparatus herein.

Alternatively, or in addition to the hooks 34 illustrated in FIG. 1, the column 12 and base 14 support a basket 200 illustrated in FIGS. 7 and 13. The basket 200 comprises a pair of identical half sections 202, 204 each of which consists of a plurality of transversely oriented, interconnected wires 206 forming a bottom wall 208, an outer wall 210 and a substantially semi-circular, upright inner wall 212. An arcuate plate 214 is mounted to the inner wall 212 of half section 202, and an identical arcuate plate 216 is mounted to the inner wall 212 of half section 204. The arcuate plates 214, 216 are adapted to encircle the column 12, and are formed with ears 217 connected to one another by screws 219 or other fasteners to form a sleeve about column 12 which permits rotation of the basket 200 with respect to the column 12 and base 14. Preferably, the bottom wall 208 of each half section 202, 204 is provided with one or more rollers 218 which rest against the top surface of the base 14 to facilitate rotation of the basket 200 therealong. The basket 200, once assembled, is adapted to support and display food items, housewares, toiletries and the like.

In the embodiment illustrated in FIGS. 1-6, the housing 16 includes a transparent, cylindrical outer wall 36 closed at the top by a cover 38 and open at the bottom to define a hollow interior 40. The outer wall 36 of the housing 16 is preferably formed of transparent plastic, although glass or other suitable transparent materials could also be utilized. Alternatively, as shown in FIG. 7, a second cylindrical wall 37 also formed of transparent material is concentrically disposed within the outer wall 36 forming an air gap 39 therebetween. The housing 16 of both embodiments is mounted atop the column 12 so that at least a portion of the column 12 is contained within the hollow interior 40 thereof.

Referring now to FIG. 2, the cover 38 of housing 16 includes an insulating seal 42 sandwiched between a closure plate 44 and a mounting plate 46, and a removable cap 45 mounted atop the plates 44, 46 and extending along the outer wall 36 of housing 16. The mounting plate 46 is secured by screws 47 to a blower mounting plate 48, described in more detail below, to mount the cover 38 atop the column support 12. The closure plate 44 and seal 42 are mounted above the mounting plate 46 by a pivot screw 50 which extends upwardly from the blower mounting plate 48 and also mounts the cap 45 in place.

The closure plate 44 and seal 42 are pivotal with respect to the mounting plate 46 to open and close an article fill opening 52 formed in the mounting plate 46. Articles 20 are stacked in vertical columns 22 within the housing 16 through the article fill opening 52 as described in more detail below. The cover plate 44 and seal 42 closes the fill opening 52 during operation of apparatus 10, as shown in FIG. 2, and are pivotal away from the fill opening 52 to permit article loading.

In one presently preferred embodiment, the articles 20 are supported within the hollow interior 40 of housing 16 by the article support carriage 18. The article support carriage 18 includes an annular support member 54 consisting of a lower, spacer plate 56, an upper plate 58 and a layer 60 of any suitable insulating material mounted therebetween. The insulating layer 60 is provided with a number of spaced plugs 62, formed of a rigid material, for mounting elements of the apparatus 10 to the support member 54 as discussed below. The article support carriage 18 further includes a mounting plate 64 fixed to the column support 12, which supports a bearing 66 preferably of the lazy-susan-type. The support member 54 is secured to the bearing 66 by screws 68*a*, *b* which extend through upper plate 58 into the plugs 62.

The support member 54 is mounted for rotation upon the bearing 66 at the open bottom of the housing 16 so that the upper plate 58 of support member 54 forms the bottom surface or floor of the housing 16. The support member 54 is rotatable with respect to the housing 16 on the bearing 66, and a seal 70 is provided between the support member 54 and outer wall 36 of housing 16 to close the hollow interior 40 of housing 16 while permitting rotation of the support member 54.

In an alternative embodiment illustrated in FIG. 7, the article support carriage 18 comprises a single plate 220 formed of a thermally non-conductive material such as plastic or wood which is mounted by the bearing 66 to the mounting plate 64. A flange 221 is mounted to the outer wall 36 of housing 16 and circumscribes the outer edge of plate 220. Preferably, an annular seal 222, formed of an elastomeric material, is mounted to the inner wall 37 of the housing 16 at the bottom edge thereof which rests atop the plate 220 forming a dynamic seal therebetween to substantially prevent the ingress of air or moisture into the housing 16 upon rotation of the plate 220 with respect to the housing 16.

Figure 3:
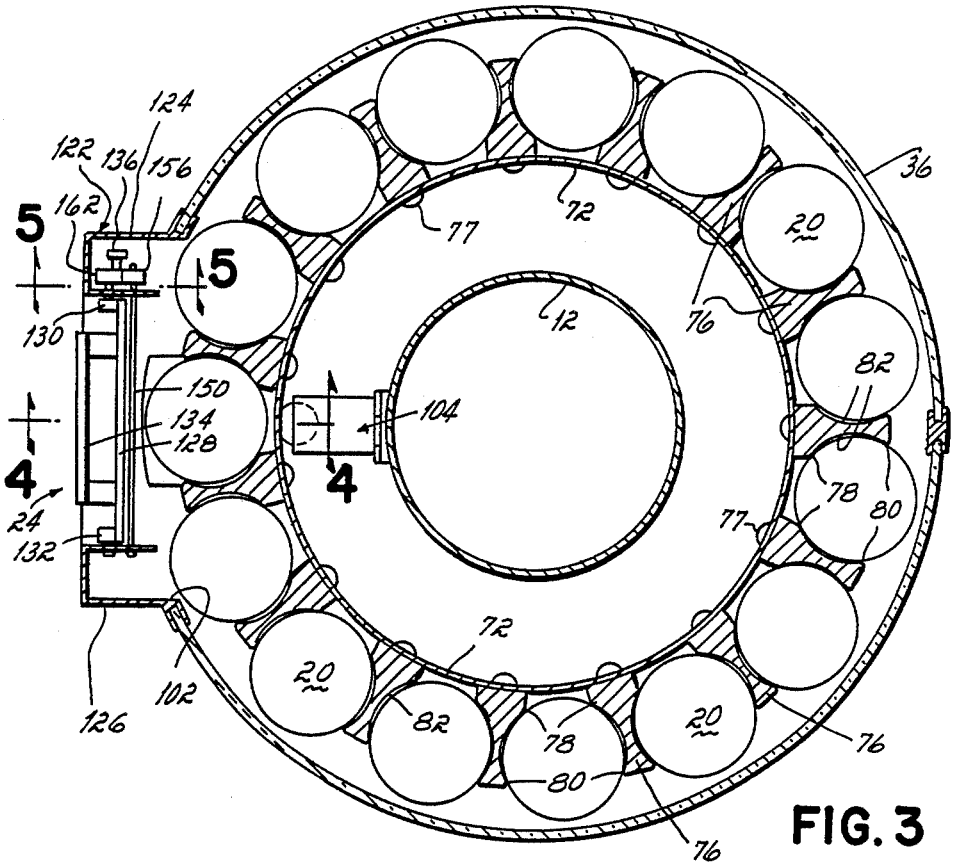
FIG. 3 is a cross sectional view of the top portion of the article display apparatus taken generally along line 3—3 of FIG. 2.

Referring now to FIGS. 2 and 3, the structure for mounting the articles 20 in vertical columns 22 within the housing interior 40 is illustrated. A cylindrical wall 72 is mounted atop article support carriage 18, which extends upwardly concentric to the column 12 toward the cover 38 of housing 16. The space between the annular wall 72 and column 12 is substantially sealed by a donut-shaped plate or baffle 74 mounted by screws 75 to the column 12 for purposes to become apparent below.

The structure for retaining the articles 20 in vertical columns comprises a plurality of spaced fins 76 mounted by screws 77 to the annular wall 72 which extend radially outwardly therefrom toward the outer wall 36 of the housing 16. Each of the fins 76 includes a rearward portion 78 connected to the annular wall 72, a forward portion 80 closest to the outer wall 36 and an arcuate center portion 82 therebetween. Adjacent fins 76 are spaced apart such that the distance between their forward portions 80 is slightly less than the diameter of an article 20 and the distance between their arcuate center portions 82 is slightly greater than the diameter of an article 20 forming a sleeve therebetween. The articles 20 are therefore retained between adjacent fins 76 and must be loaded into the housing 16 vertically through the fill opening 52 in the housing cover 38. Each of the fins 76 is formed with a cut-out 79 near the bottom to permit the removal of an article 20.

Figure 6:
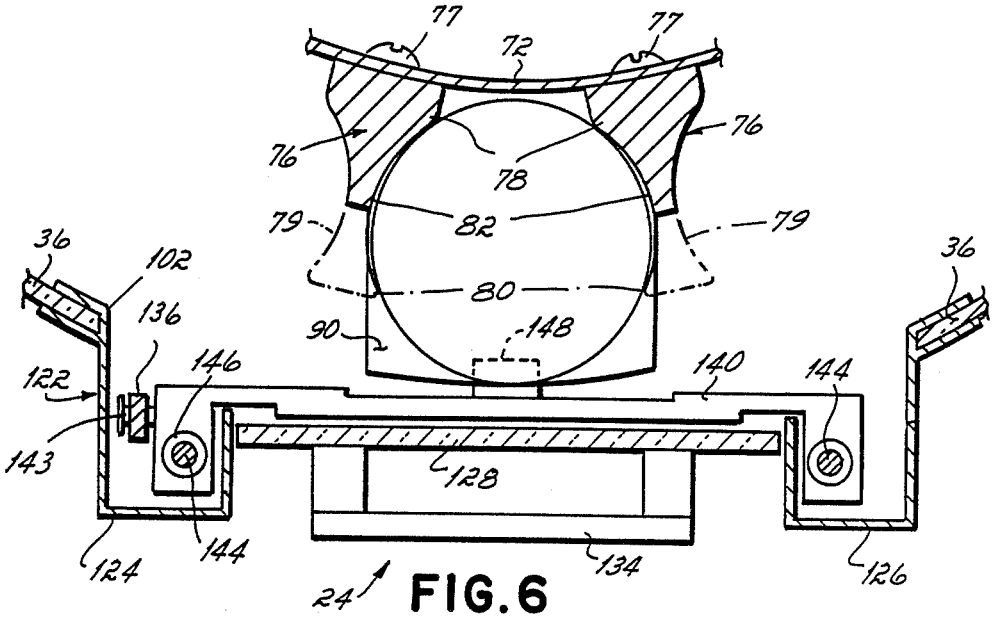
FIG. 6 is a partial plan view, in partial cross section, of the door mechanism of this invention and one of the vertical columns of articles to be removed at the door.

In the embodiment of this invention shown in the FIGS., fifteen fins 76 are spaced about the annular wall 72 to form fifteen vertical columns 22 of articles 20. It should be understood that the number of vertical columns 22 could be altered as desired by increasing or decreasing the diameter of annular wall 72 and/or the spacing between adjacent fins 76. In addition, articles 20 of different diameter or shape could be accommodated by varying the spacing between adjacent fins 76 and/or the shape of their center portions 82. The vertical columns 22 depicted in FIGS. 3 and 6 are especially suited to accommodate cylindrical articles, such as beverage cans.

Figure 4:
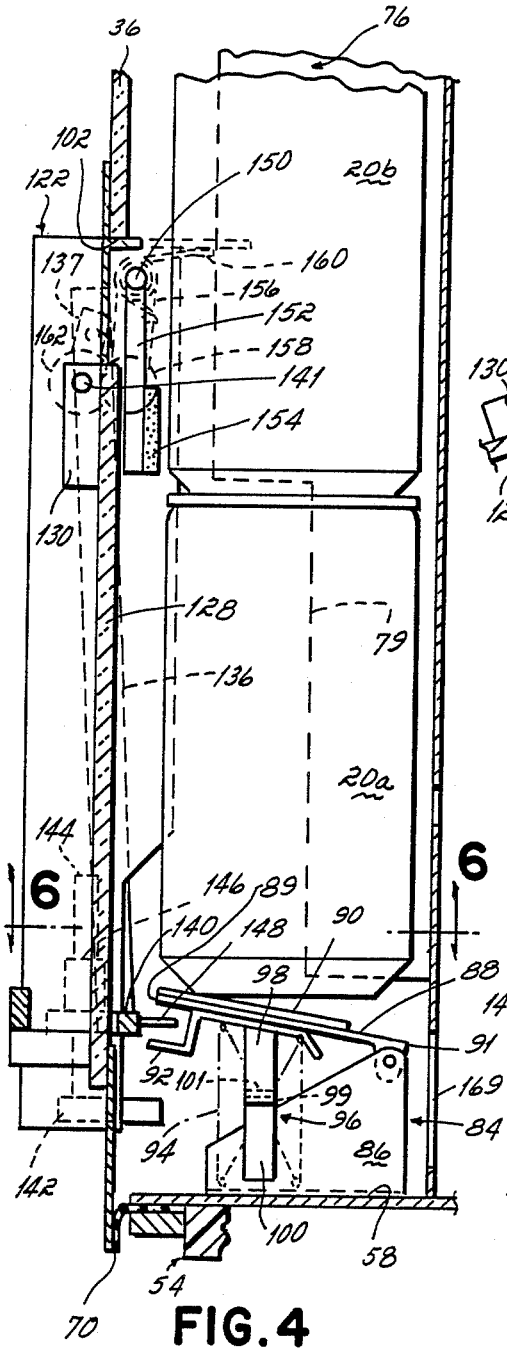
FIG. 4 is an enlarged cross-sectional view of the door of this invention taken generally along line 4—4 of FIG. 3, showing the door in a closed position.
Figure 4A:
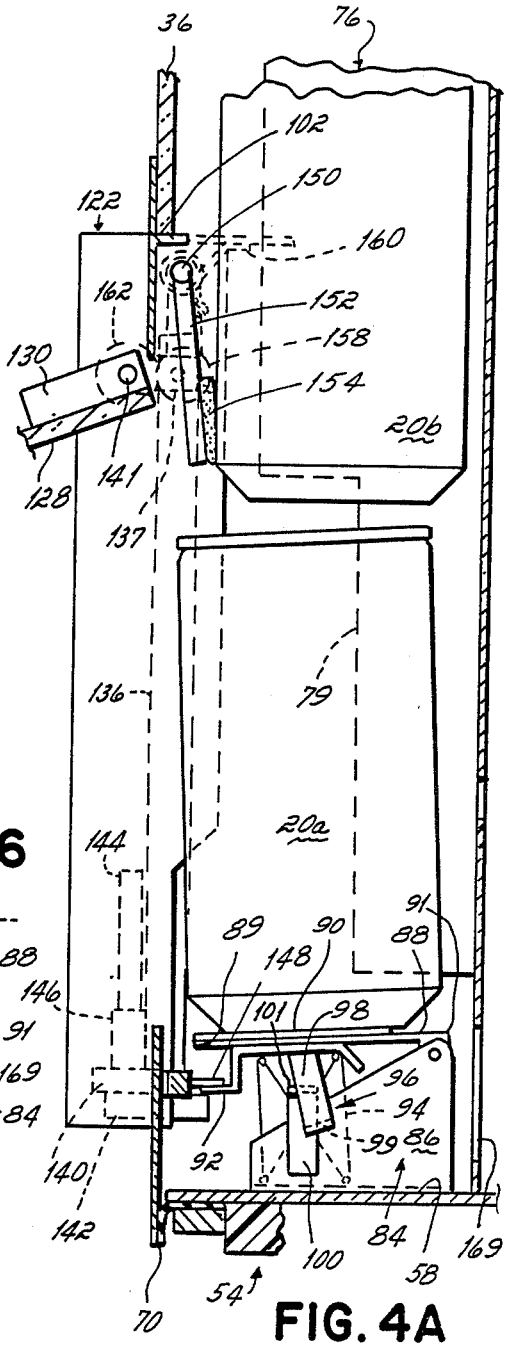
FIG. 4*a* is a view similar to FIG. 4 with the door in an opened position.

In the embodiment shown in FIGS. 4 and 4*a*, each vertical column 22 of articles 20 is supported atop the article support carriage 18 by an article support 84. Each article support 84 includes a pair of spaced brackets 86 mounted to the support member 54 of article support carriage 18, and a plate 88 which extends between the brackets 86 and is pivotally mounted thereto. A frictional contact pad 90 formed of vinyl, urethane or a similar material is mounted atop the plate 88 for engaging the base of an article 20, and a flange 92 is mounted beneath the plate 88. The plate 88 is pivotal between an article support position shown in FIG. 4 in which the forward end 89 of plate 88 is spaced above its rearward end 91, and an article removal position shown in FIG. 4*a* in which the forward end 89 of plate 88 is disposed slightly below its rearward end 91. A spring 94 mounted between the support member 54 of carriage 18 and plate 88 functions to return the plate 88 from its article removal position to the article support position. The spring 94 also acts as the shock absorber, in combination with the contact pad 90, to absorb noise and shock caused by loading of the articles 20 into the housing 16.

In addition, a stop 96 is provided which comprises an upper L bracket 98 mounted to the flange 92 and a lower L bracket 100 mounted to the support member 54. The upper and lower L brackets 98, 100 are formed with flanges 99, 101, respectively, which engage one another in the article support position shown in FIG. 4 to limit the upward travel of the plate 88 caused by spring 94. The flanges 99, 101 of upper and lower L brackets 98, 100 disengage with the downward movement of plate 88 to its article removal position as shown in FIG. 4*a*.

Figure 11:
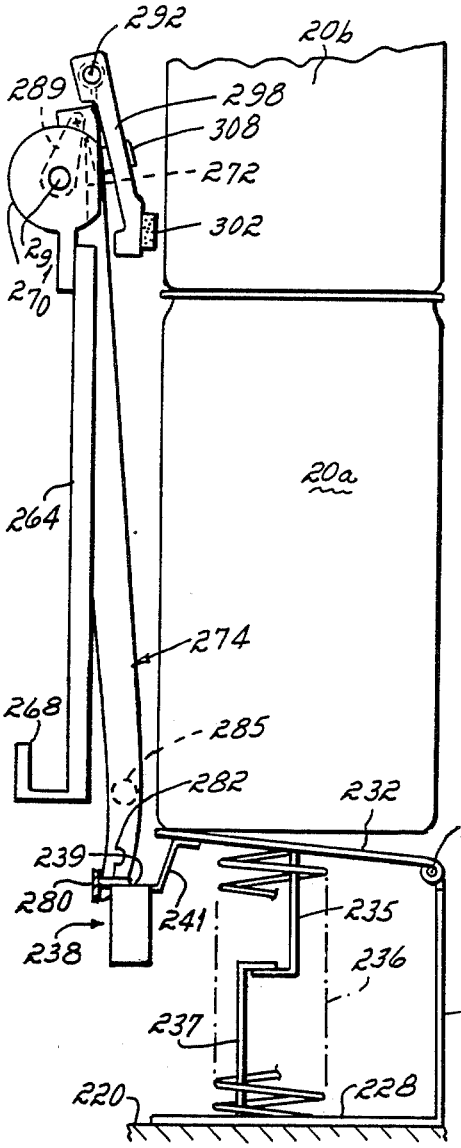
FIG. 11 is a schematic, isometric side view of the door assembly of FIGS. 7-10, with the door panel of the door assembly in a closed position.
Figure 12:
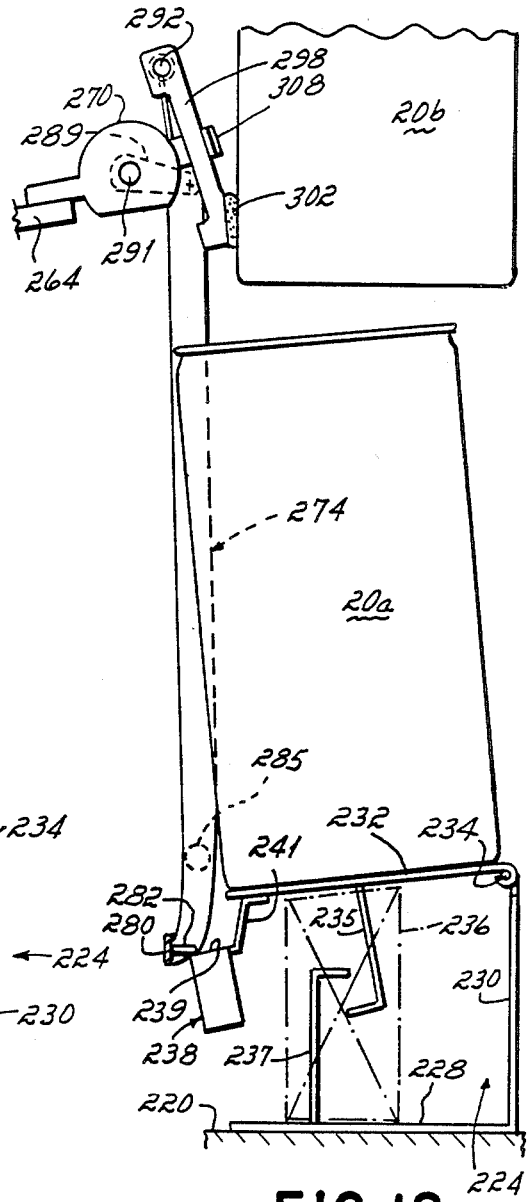
FIG. 12 is a view similar to FIG. 11 with the door panel in an open position.

Referring now to FIGS. 7, 11 and 12, an alternative embodiment of an article support 224 is illustrated. The article support 224 comprises an L-shaped bracket having a lower leg 228 fixed to the plate 220 of article support carriage 18, and an upright leg 230 connected to the lower leg 228. A pivot plate 232 is mounted to the upright leg 230 by hinge 234 which is movable between an upwardly tilted, article support position as shown in FIG. 11 and a downwardly tilted, article discharge position as shown in FIG. 12. The pivot plate 232 is urged toward its article support position by a spring 236 which extends between the lower leg 228 and pivot plate 232. Mating L-shaped brackets 235, 237 are disposed within the spring 236 and are mounted to the underside of pivot plate 232 and the plate 220, respectively. The brackets 235, 237 engage one another to prevent the pivot plate 232 from moving beyond the outside support position shown in FIG. 11, and disengage one another when the pivot plate 232 is tilted to the article discharge position shown in FIG. 12.

The pivot plate 232 is formed with a leading edge closest to the outer wall 37 beneath which a bracket 238 is mounted to an L-shaped flange 241. The bracket 238 comprises a center section 239 connected to outwardly and downwardly extending wing portions 240, 242. See FIG. 8. As discussed in detail below, a pusher mechanism operable in response to the opening and closing of the door panel of this invention engages the center section 239 of bracket 238 to move the pivot plate 232 between its article support position and article discharge position.

The article support carriage 18, and, in turn, the vertical columns 22 of articles 20, are rotatable with respect to the fixed column support 12 and housing 16. In the embodiment illustrated in FIGS. 1–6, the transparent outer wall 36 of housing 16 is formed with an access opening 102 near the bottom to permit removal of articles 20 from the housing interior 40. In order to insure that the vertical columns 22 of articles 20 align with the access opening 102, a locator 104 is provided. As shown in FIG. 2, the locator 104 includes a casing 106 extending between the column support 12 and annular wall 72. One end of the casing 106 is mounted to the column support 12 and its opposite end receives a ball 108 which is biased toward the annular wall 72 by a spring 110 contained within the casing 106. The spring-biased ball 108 is adapted to seat within a plurality of spaced locator holes 112 formed in the same horizontal plane in the annular wall 72.

The article support carriage 18 is rotated by an annular ring 114 mounted to the article support carriage 18 by five pairs of upper and lower flanges 116, 118, respectively, connected together by bolts 119, only two of which are shown in FIG. 2. By grasping the annular ring 114, the consumer can rotate the article support carriage 18 so that the desired vertical column 22 of articles 20 is positioned in alignment with the access opening 102 in the outer wall 36 of housing 16. The locator 104 functions to index the article support carriage 18 to the proper position with respect to the access opening 102 so that a selected vertical column 22 of articles 20 directly aligns with the access opening 102.

Figure 5:
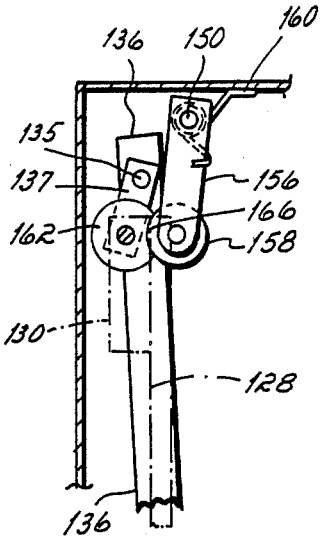
FIG. 5 is a partial cross-sectional view of the door herein taken generally along line 5—5 of FIG. 3 with the door closed.

Referring now to FIGS. 4–6, one embodiment of a door assembly 24 is mounted to the access opening 102 formed in the outer wall 36 of housing 16. The door assembly 24 functions to permit removal of one article 20 at a time from each vertical column 22. As described in detail below, this is accomplished by presenting the lowermost article 20*a* in the vertical column 22 in a position for removal from the housing 16, preferably by tipping it at a slight angle toward the outer wall 36 of housing 16 for easy removal, and gripping the next article 20 in the column 22 to retain all of the remaining articles 20 in place while the lowermost article 20*a* is removed.

The door assembly 24 comprises a mounting bracket 122 mounted around the edges of the access opening 102 which includes a pair of spaced, inwardly extending mounting flanges 124, 126. The space between mounting flanges 124, 126 is spanned by a door panel 128 which is pivotally mounted to the mounting flanges 124, 126 by a pair of support bars 130, 132. A handle 134 is mounted to the base of door panel 128 for pivoting it between a closed position shown in FIG. 4, and an open position shown in FIG. 4*a*.

The structure of the door assembly 24 for dispensing the lowermost article 20*a* from the housing 16 comprises a pair of spaced pivot arms 136, 138 each mounted at their upper ends by a pin 135 to a connector bar 137, which, in turn, is mounted to a rod 141. Only one of the connector bars 137 and rods 141 are shown in the drawings for ease of illustration. The other end of each rod 141 is connected to one of the support bars 130, 132 for pivotal movement therewith. The lower ends of pivot arms 136, 138 are fixed by a pair of pins 143 to opposite ends of a push bar 140 which extends across substantially the entire width of access opening 102 and is held in a generally horizontal position by the pivot arms 136, 138.

A pair of pads 142 are fixed to opposite sides of the base of the access opening 102, only one of which is shown in the drawings. Each of the pads 142 mounts an upright, guide rod 144 received within a bore (not shown) formed in the opposite ends of push bar 140. A pair of sleeves 146 are mounted within the opposed bores of the push bar 140 which are adapted to slide along a respective guide rod 144. The inner edge of the push bar 140 includes an extension or finger 148 which is adapted to engage the flange 92 of the article support 84.

The door assembly 24 dispenses the lowermost article 20*a* in the following manner. With the door panel 128 in the closed position as shown in FIG. 4, the lowermost article 20*a* rests atop the plate 88 of article support 84. The article support 84 is disposed in its article-support position by L-brackets 98, 100 wherein the forward end 89 of plate 88 is spaced vertically above the rearward end 91 thereof forming an angle, for instance, of approximately 10° with respect to horizontal. In this position, the finger 148 of push bar 140 is disposed between the plate 88 and flange 92 of article support 84 so that the article support carriage 18 may be rotated relative to the door 24 without interference between the push bar 140 and article support 84.

As the door panel 128 is opened, the support bars 130, 132, and connector bars 137, 139, rotate in a clockwise direction and urge the pivot arms 136, 138 downwardly toward the article support carriage 18. In turn, the push bar 140 is moved downwardly in an essentially vertical path along the guide rod 144. The finger 148 of push bar 140 engages the flange 92 of article support 84 and pivots the article support 84 to its article removal position as shown in FIG. 4a. In this position, the forward end 89 of plate 88 is disposed slightly vertically below its rearward end 91 so that the lowermost article 20*a* is tilted or tipped slightly forwardly toward the outer wall 36 of housing 16 for easy removal therefrom. The article support 84 is returned to its original position by spring 94 as the door panel 128 is closed.

The angles at which the plate 88 of article support 84 is disposed in both its article support position and article removal position are chosen to permit the efficient dispensing of a lowermost article 20*a*. As illustrated in the drawings, the articles 20 are beverage cans having a beveled bottom surface which at least partially nests within the top surface of the can beneath. In order for the lowermost article 20*a* to clear the article 20*b* immediately above, the lowermost article 20*a* must be permitted to move vertically downwardly with respect to the article 20*b*. The angle of the plate 88 in its support position permits sufficient downward movement of the lowermost article 20*a* as the article support 84 moves to a removal position to clear article 20*b* above.

The angle of article support 84 in its support position, while permitting clearance between adjacent articles 20*a*, 20*b*, is also small enough to prevent the lowermost article 20*a* from being tipped forwardly out of the housing 16 even when the door panel 128 is lifted quickly. In fact, as the door panel 128 is raised, the angular velocity of the article support 84 actually decreases. The chance of articles 28 tipping out of the housing is further reduced by the angle at which the article support 84 is disposed in its article removal position. Preferably, such angle is less than about 10° causing the lowermost article 21 to tilt only slightly for ease of removal without tipping over, out of the housing 16 and onto the floor.

Before the lowermost article 20a is presented at the access opening 102 in the outer wall 36, the articles 20 above in the vertical column 22 above the lowermost article 20 must be maintained in position. The article gripping structure of the door assembly 24 herein is also illustrated at FIGS. 4 and 4*a*. A rod 150 is rotatably mounted to the flanges 124, 126 of mounting bracket 122. A plate 152 is fixed to the rod 150 and is pivotal therewith toward and away from the articles 20 in vertical column 22. The plate 152 is preferably provided with a pad 254 of vinyl or other material having a high coefficient of friction. As illustrated in FIGS. 4 and 4*a*, the rod 150 is positioned so that the plate 152 aligns with the article 20*b* immediately above the lowermost article 20*a* in the vertical column 22.

One end of rod 150 is mounted to a connector arm 156 having a roller 158 at its opposite end. The roller 158 is biased by a spring 160 into engagement with a cam 162 mounted on the rod 141, which connects to the support bar 130. The cam 162 is formed with a notch 166 which is adapted to receive the rod 164 with the door panel 128 in its closed position.

Figure 5A:
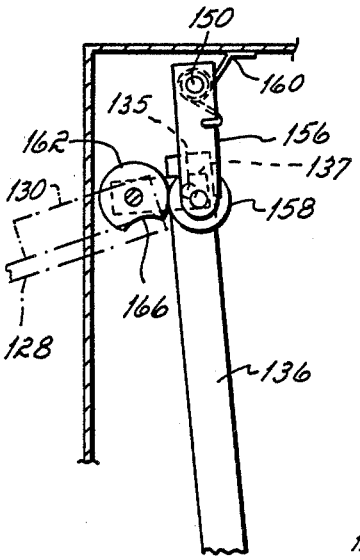
FIG. 5*a* is a view similar to FIG. 5 with the door in an opened position.

As best shown in FIGS. 4–5*a*, the cam 162 is rotated in a clockwise direction in response to opening of the door panel 128. AS the roller 158 is unseated from the notch 166 in cam 162, the connector arm 156 is forced rearwardly away from the outer wall 36 of housing 16. This movement pivots the rod 150 so that the pad 154 of plate 152 engages the bottom portion of the article 20*b* immediately above the lowermost article 20*a* in vertical column 22. The plate 152 secures the article 20*b*, and all those above it in vertical column 22, firmly in place while the lowermost article 20*a* is removed from the housing 16.

When the door panel 128 is substantially closed, the roller 158 seats within the notch 166 of cam 162, thereby rotating the rod 150 in the opposite direction to release the pad 152 from engagement with the article 20*b*. In this position of roller 158, the spring 160 functions to maintain the door panel 128 in a closed, sealed position. All of the articles 20 are then allowed to drop downwardly so that the article 20*b* is now the lowermost article atop the article support 84 in a position for dispensing. The notch 166 in cam 162 is preferably formed so that the roller 158 does not seat within the notch 166, even with the door panel 128 in its closed position, so that a positive closing force is applied to the door panel 128 to retain it in a closed position. This prevents the articles 20 in vertical column 22 from being released prematurely while the door panel 128 is opened sufficiently for a small child to reach into the access opening 102, thereby reducing the chance of injury.

It should be understood that the lowermost article 20*a* need not be removed from the housing 16. If, for example, the customer changes his mind and wishes to make another selection, the door panel 128 is first closed to return the article 20*c* to its original position in FIG. 4, and the housing is then rotated to align another column 22 of articles 20 with the door 26.

Referring now to FIGS. 8–12, an alternative embodiment of the door assembly 24 is illustrated. The door assembly 244 in FIGS. 8–12 operates with the same principle for dispensing articles 20 from the housing 16 as door assembly 24, i.e., presenting the lowermost article 20*a* in a position for removal from the housing 16 while gripping the remaining articles 20 in the column 22 to maintain them in place. Additionally, the door assembly 244 provides for the tipping of the lowermost article 20*a* forwardly toward the outer walls 36, 37, and separating the lowermost article 20*a* from the remaining articles 20 in the column 22, for purposes of dispensing one article 20 at a time as described in detail in connection with the FIGS. 1–6 embodiment.

The door assembly 244 comprises a frame 246 which is glued or similarly affixed around the edges of the outer walls 36, 37 formed by an access opening 248. As best shown in the plan views of FIGS. 9 and 10, the frame 246 comprises opposed outer panels 250, 252, located at opposite sides of the access opening 248, which are each formed with a slot 254 adapted to mount to the outer walls 36, 37 of housing 16. The outer panels 250, 252 are connected by legs 256, 258 to opposed inner panels 260, 262, respectively. A door panel 264 spans the inner panels 260, 262. The lower end of the door panel 264 has a handle 268, and an extension 270 is mounted to the upper end of the door panel 264 which is formed with a cam surface 272 for purposes to become apparent below. See FIGS. 11 and 12.

Figure 8:
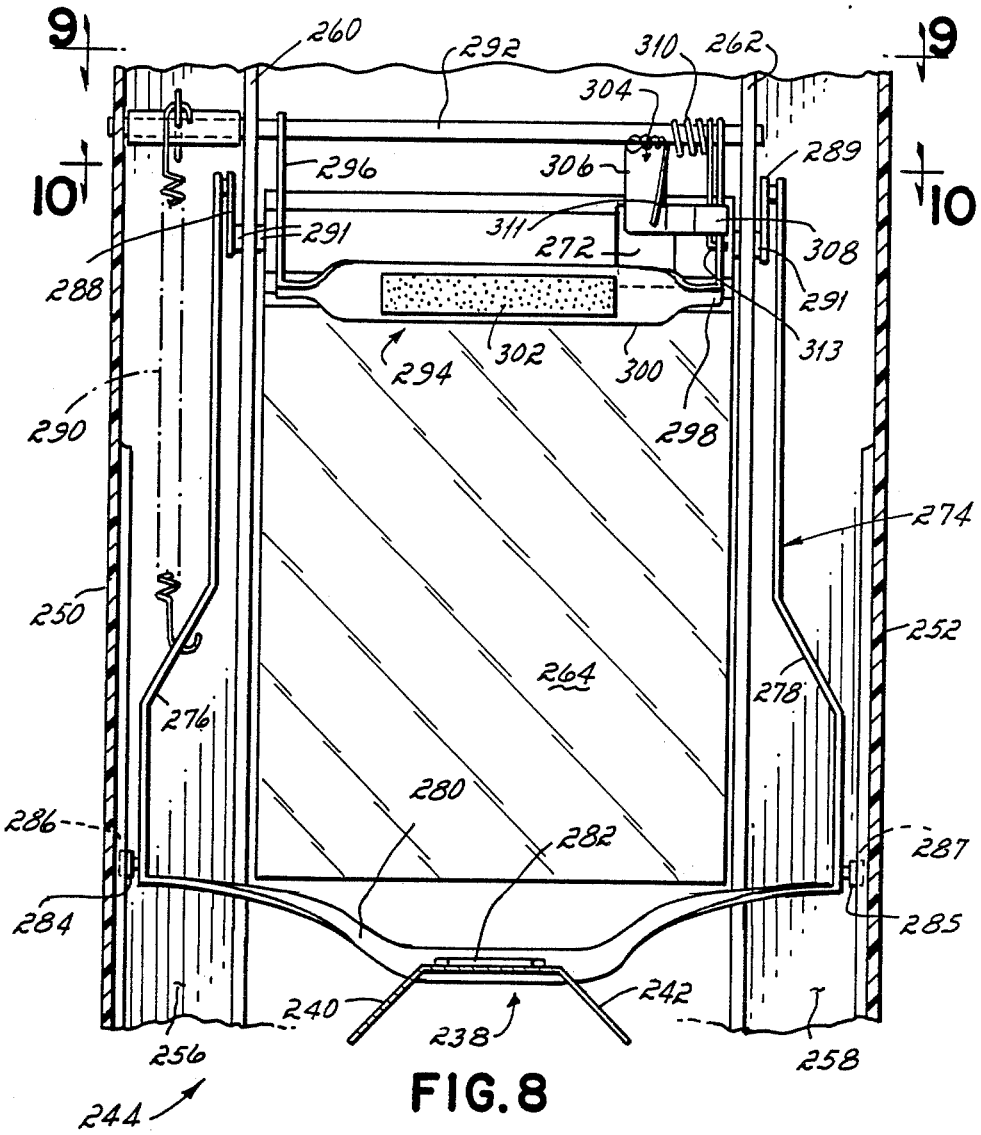
FIG. 8 is an enlarged view in partial cross section of the door assembly in the FIG. 7 embodiment, taken generally along line 8—8 of FIG. 7.
Figure 9:
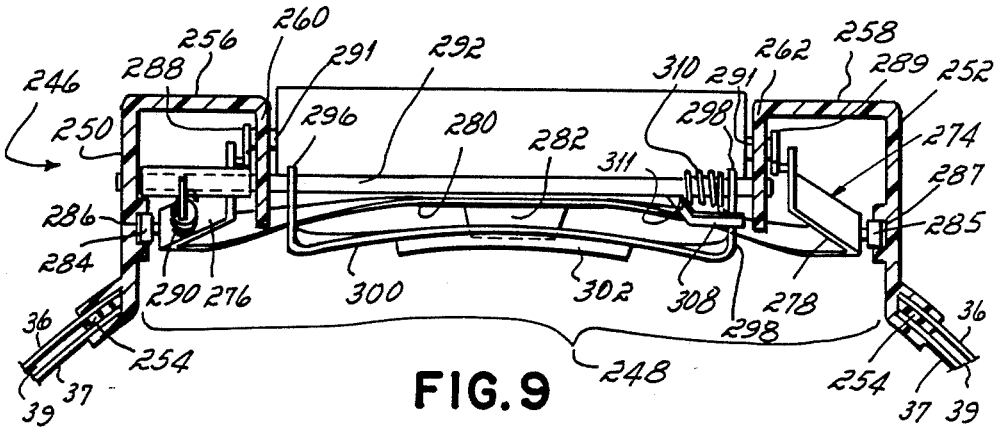
FIG. 9 is a plan view of the door assembly in FIG. 8, taken generally along line 9—9 of FIG. 8.
Figure 10:
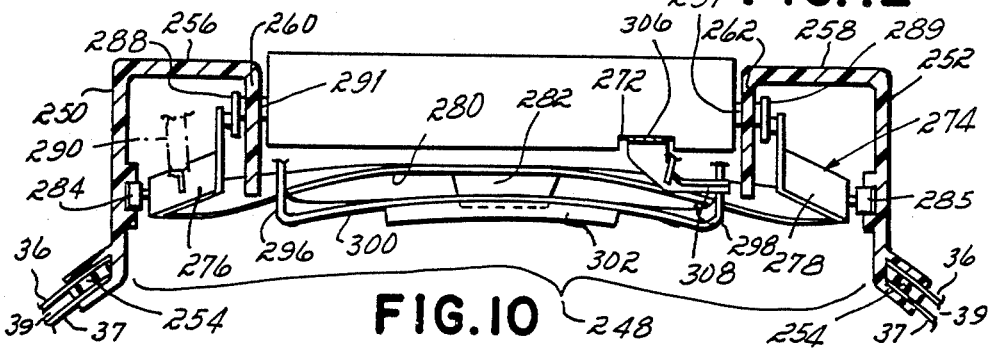
FIG. 10 is a cross sectional view of the door assembly of FIG. 8 taken generally along line 10—10 thereof.

Referring now to FIGS. 8, 9 and 10, the structure for tilting the article support 224 between an article support position and an article discharge position is illustrated. A U-shaped pusher 274 is provided which comprises opposed, generally vertically extending arms 276, 278 each connected at their lower end to a horizontal arm 280 having a tab 282. Pins 284, 285 are mounted to the lower end of each of the vertical arms 276, 278, respectively, which are movable within guide channels 286, 287 formed in each of the outer panels 250, 252 of the frame 246. The upper end of the vertical arms 276, 278 are connected to crank arms 288, 289, respectively, which are mounted by pins 291, to the extension 270 of door panel 264. The door panel 264 is rotatable on the pins 291 between an open and closed position. See FIGS. 11 and 12.

The operation of the article discharge structure of door assembly 244 is as follows. When the door panel 264 is pivoted to an open position as shown in FIG. 12, the crank arms 288, 289 connected to the extension 270 of the door panel 264 pivot and force the pusher 274 downwardly. The downward movement of the pusher 274 is guided by the movement of the pins 284, 285 within the guide channels 286, 287. As illustrated in FIGS. 11 and 12, the tab 282 mounted to the horizontal arm 280 of the pusher 274 engages the center section 239 of bracket 238 carried by the pivot plate 232 of article support 224. This causes the pivot plate 232 to tilt downwardly, toward the plate 220, and assume an article discharge position to facilitate removal of the lowermost article 20*a* from the access opening 248 in the housing 16. After the lowermost article 20*a* is removed, the door panel 264 is closed and maintained in a closed position over the access opening 248 by operation of a return spring 290 which is mounted to the vertical arm 276 of the pusher 274 and a collar 293 rotatably mounted on a rod 292. The rod 292 extends between the inner panels 260, 262 of door frame 246 near the top of the access opening 248; and is held in position relative to the inner panels 260, 262 by the collar 293.

The wing sections 240, 242 of bracket 238 are provided to prevent the tab 282 of pusher 274 from extending beneath the center portion 239 of a bracket 238 of an adjacent vertical column 22. With the door panel 264 in an open position, the tab 282 is positioned vertically beneath the center portion 239 of the bracket 238 of any adjoining vertical column 22. In the event the article support carriage 18 is rotated relative to the housing 16 with the door panel 264 in an open position, the wings 240, 242 engage the tab 282 and prevent it from moving beneath the center portion 239 of adjoining bracket 238. This avoids interference between the tab 282 and bracket 238 when the door panel 264 is moved back to the closed position.

The structure of door assembly 244 for gripping or retaining the remaining articles 20 in the column 22 while the lowermost article 20*a* is being removed is illustrated at the top of FIG. 8 and in FIGS. 9–12. This structure comprises a U-shaped article gripper 294 having opposed arms 296, 298 which are mounted at their upper end to rod 292 and interconnected at their lower end by a horizontal arm 300 carrying a friction pad 302. An L-shaped pivot plate 304 is formed with a generally vertical leg 306 connected to a generally horizontal leg 308, as viewed in FIG. 8. The vertical leg 306 of the pivot plate 304 is mounted at one end to the rod 292 and its opposite end rides upon the cam surface 272 of the door panel extension 270. The horizontal leg 308 of pivot plate 304 rests atop the vertical arm 298 of article gripper 294. One end 311 of a spring 310 carried by the rod 292 rests atop the vertical leg 306 of the pivot plate 304. The pivot plate 304 is retained against the cam surface 272 of door panel extension 270 by spring 290 which tends to rotate rod 292 so that the end 311 of spring 310 bears against the vertical leg 306 of pivot plate 304. This forces the vertical leg 306 against the cam surface 272 and the horizontal leg 308 of pivot plate 304 against the vertical arm 298 of the article gripper 294. The opposite end 313 of the spring 311 extends beneath the arm 298 of article gripper 294 and exerts an inwardly directed force thereon tending to urge the article gripper 294 toward the articles 20.

The operation of the article gripping structure of door assembly 244 is best shown in FIGS. 8, 11 and 12. With the door panel 264 in the closed position, as shown in FIG. 11, the horizontal arm 300 of the article gripper 294 is spaced from the article 20*b* immediately above the lowermost article 20*a*. Upon moving the door panel 264 to an open position as shown in FIG. 12, the pivot plate 304 is forced toward the articles 20 by the cam surface 272 of the door panel 264 so that its horizontal arm 308 disengages the article gripper 294. This allows the opposite end 313 of spring 310 to act upon the article gripper 294 and pivot it inwardly so that the friction pad 302 mounted to horizontal arm 300 engages the article 20*b* immediately above the lowermost article 20*a*. Article 20*b*, and all of the other articles 20 within the column 22, are therefore retained in a fixed position while the lowermost article 20*a* is being removed from the column 22 as discussed above.

Referring now to FIGS. 1, 2 and 7, in the event the articles 20 displayed within the apparatus 10 must be refrigerated, a cooling system 26 is provided. That portion of the column 12 contained within the interior 40 of housing 16 is hollow forming a passageway 27. The column 12 includes a plurality of spaced air inlet openings 168 at the bottom of the passageway 27 near the article support carriage 18 and a plurality of air outlet openings 170 at the top of the housing 16. A cooling coil 172 is mounted within the hollow column support 12 between the openings 168, 170, which is connected by an inlet and outlet line 174, 176, respectively, to a compressor 178 mounted in the base 14. The compressor 178 is driven by a motor 180 also mounted in the base 14. Mounted at the top of the column 12 is a blower mounting plate 48. Both the compressor 178 and blower 182 are cycled on and off at the same time by a switch (not shown) mounted in the base 14. The switch is operatively connected to a thermocouple 183 which is mounted to the column 12 at the base of the housing 16 and is adapted to sense the temperature in the interior 40 of the housing 16. See FIG. 7. For example, the switch can be set to cycle both the compressor 178 and blower 182 on when the temperature in housing 16 reaches 40° F., and then shut off when the temperature is reduced to about 32° F.

The cooling system of this invention operates as follows. The compressor 178 pumps a refrigerant in liquid phase, such as liquid freon, into the lower portion of the cooling coil 172 at the base of housing 16. When the liquid refrigerant enters the cooling coil 172 it vaporizes and moves in gaseous state upwardly to the top of the cooling coil 172 where it is discharged into the outlet line 176 and returned to the compressor 178 in liquid phase. In the course of moving through the cooling coil 172, the gaseous refrigerant cools the coil 172 and gradually increases in temperature so that the lower portion of the coil 172 is a few degrees cooler than the upper portion thereof. Since the column 12 is formed of a thermally conductive material, it too is cooled by the cooling coil 172 and has approximately the same temperature gradient from bottom to top as the cooling coil 172, i.e., the temperature at the bottom of the column 12 within housing 16 is slightly colder than the top portion thereof.

The blower 182 draws air from the interior 40 of housing 16 into the openings 169 formed in the annular wall 72, through the inlet openings at the base of column 12 into its internal passageway 27 and then out the outlet openings 170 in column 12. In the course of passing through the column 12, the air becomes chilled. The closure plate 74 blocks the flow of cool air from the outlet openings 170 in column 12 into the space between the column 12 and annular wall 72, so the cool air from the outlet openings 170 is directed into the space 181 between annular wall 72 and the outer wall 36 of housing 16. The cooled air flows over the articles 20, and also over the thermally conductive fins 76 mounted to the annular wall 72.

This arrangement provides an extremely efficient and effective means for quickly and uniformly cooling articles 20 within the housing 16. Cooling is achieved not only by direct contact of the articles 20 with the cooled air, but also by conduction and/or radiation between the cooled, thermally-conductive surfaces of the fins 76 and annular wall 72 and the articles 20. In addition, the path of the cooling air is in a direction from the slightly warmer top end of the column 12 toward the cooler bottom portion of the column 12 where the cooling coil 172 is also colder. This prevents the articles 20 at the bottom of housing 16 from freezing and ensures that the articles 20 at the top of the housing 16 are sufficiently cooled.

Moisture introduced into the housing interior 40 through the door 24 condenses on the cooling coil 172. The operation of the blower 182 continues through the defrosting cycle for cleaning the cooling coil 172 of condensate. This moisture is collected beneath the cooling coil 172 by a funnel 183 mounted within the column support 12 thereat. The funnel 183 is connected by a drain line 185 to an evaporator tray 187 disposed within the base 14. The moisture collected in the evaporator tray 187 is evaporated by the heat generated while operating the motor 180 and compressor 178.

In the embodiment illustrated in FIGS. 1–6, the article display apparatus 10 also includes a defogging system for maintaining the transparent outer wall 36 of housing 16 essentially free from condensation. The column support 12 is formed with four spaced outlet openings 188 beneath the housing 16, only two of which are shown in FIGS. 1 and 2. An annular, conical-shaped plate 190 having an upright outer lip 192 is fixed to the column support 12 beneath the outlet openings 188. The annular plate 190 extends radially outwardly from the column support 12 and tapers upwardly toward the housing 16 so that its upright lip 192 is disposed substantially parallel to the exterior of the outer wall 36 of housing 16. A vent 194 is stamped into the base 14, and is preferably formed in the shape of a logo or other identifying indicia.

The defogging system operates by drawing outside air through the vent 94 and over the heated, operating compressor 174 and motor 176. This heats the ambient air to some degree and it travels upwardly through the hollow column support 12 and out the outlet openings 188. The heated air is then directed by the annular plate 190 radially outwardly from the column support 12 to the upright lip 192 of annular plate 190 where the air stream is turned upwardly between upright lip 192 and the base of the door mounting bracket 122. The air stream is thus directed vertically upwardly along the exterior surface of the outer wall 36 of housing 16 to prevent moisture from accumulating thereon and obstructing a view of the housing interior 40.

The defogging system is eliminated in the embodiment shown in FIGS. 7–13 by the provision of a second wall 37 spaced by an air gap 39 from outer wall 36. Additionally, the dynamic seal created by the seal 222 assists in preventing the ingress of moisture into the housing 16.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, although the housing 16 was illustrated in the drawings as having an annular outer wall 36, it is contemplated that square, rectangular or other shaped outer walls could be utilized in accordance with the teachings of this invention. In addition, it is contemplated that articles other than the beverage cans illustrated herein, including those of different shape and/or articles containing non-food items, could be dispensed from the apparatus of this invention. In the event the articles to be displayed do not require refrigeration, the apparatus herein is easily modified to remove the cooling and defogging systems to accommodate such articles.

It is also contemplated that the door assembly 24 herein could be modified to perform essentially the same function as described above; that being, to clamp the articles in the vertical column above the lowermost article to be removed and to present the lowermost article for removal so that it clears the articles above. As described and illustrated in the drawings, the lowermost article **20*a* is moved downwardly to clear the article 20*b* above, and then lifted outwardly for dispensing. At the same time, the article 20*b* is clamped against the fins 76 to support the remaining articles 20 in the vertical column. Other mechanisms for performing these functions may also be utilized. For example, means could be provided for not only clamping article 20*b* but lifting it, and the articles 20 stacked above, upwardly to provide clearance for removal of the lowermost article 20*a*. In this embodiment, the lowermost article 20*a* would remain stationary prior to removal from housing 16. In addition, the lowermost article 20*a* need not be tilted forwardly to clear the article 20*b*** above, but only moved vertically downwardly.

Therefore, it is intended that the invention not be limited to the particular embodiment disclosed as the best mode contemplated for carrying out this invention, but that the invention will include all embodiments falling within the scope of the appended claims.

What is claimed is:

1. An article display apparatus comprising:

a base support;

a housing mounted to said base support, said housing having a hollow interior defined by transparent outer wall means formed with an article access opening;

an article support carriage mounted to said base support beneath said housing, said article support carriage having a plurality of spaced article supports each adapted to support articles in vertical columns within said hollow interior of said housing, said article supports being pivotal between an article support position and an article removable position;

a door assembly mounted to said outer wall means of said housing at said article access opening therein, said door assembly comprising:

(i) a door panel movable between an open position for permitting removal of articles from said housing through said article access opening therein, and a closed position in which said article access opening is closed, said door panel being formed with a cam surface;

(ii) a column support arm having a gripper element, said column support arm being movable between a retracted position spaced from said vertical columns of articles and a support position in which said gripper element contacts the article immediately above the lowermost article in said vertical column to retain the remaining articles in position in said vertical column;

(iii) pivot means mounted in operative engagement with said column support arm and said cam surface of said door panel, said pivot means being movable relative to said cam surface in a first direction to urge said column support arm into said support position in response to opening of said door panel, said pivot means being movable relative to said cam surface in a second direction to urge said column support arm into said retracted position in response to closing of said door panel;

(iv) pusher means operatively connected to said door panel for pivoting said article supports to said article support position upon closing said door panel and for pivoting said article supports to said article removal position upon opening said door panel; and cooling means for cooling said hollow interior of said housing.

2. The article display apparatus of claim 1 in which said article supports mounted to said article support carriage each comprise:

a bracket fixedly mounted atop said article support carriage;

an article support plate pivotally mounted to said bracket, said article support plate being pivotal between said article support position and said article removal position;

a spring mounted between said article support plate and said article support carriage for biasing said article support plate to said article support position; and a push plate connected to said article support plate, said push plate being formed with a center portion connected to opposed wing portions, said pusher means being engageable with said center portion of said push plate to pivot said article support plate between said article support position and said article removal position.

3. The article display apparatus of claim 1 in which said outer wall means of said housing comprises a first and second cylindrical-shaped section of transparent material, said second section being concentrically disposed within said first section to form an air gap therebetween.

4. The article display apparatus of claim 1 in which one of said article support carriage and said housing is rotatable relative to the other, said housing having a flexible, elastomeric seal which contacts said article support carriage to substantially prevent the ingress of air and moisture into said hollow interior of said housing upon rotation of said article support carriage or said housing.

5. The article display apparatus of claim 1 in which said pivot means comprises:

a pivot arm mounted in engagement with said cam surface of said door panel and resting against a first side of said column support arm;

a spring having one end resting atop said pivot arm to urge said pivot arm into engagement with said cam surface of said door, and a second end resting against a second side of said column support arm opposite said first side thereof; and said pivot arm being movable with said cam surface in response to opening of said door panel to disengage said column support arm allowing said second end of said spring to urge said column support arm to said support position to retain the articles in position in said vertical column, said pivot arm being movable with said cam surface in response to closing of said door panel to engage said column support arm and move said column support to said retracted position.

6. The article display apparatus of claim 1 in which said pusher means comprises:

a pusher element having a pair of opposed vertical arms each having an upper end and a lower end connected to a horizonal arm formed with a tab; and a crank arm for pivotally mounting said upper end of each of said vertical arms of said pusher element to said door panel, said crank arms being operable in response to opening of said door panel to move said pusher element downwardly so that said tab of said horizontal arm moves said article support of said article support carriage to said article removal position, said crank arms being operable in response to closing of said door panel to move said pusher element upwardly so that said tab of said horizontal arm disengages said article support to permit movement of said article support to said article support position.

7. The article display apparatus of claim 6 in which said pusher element includes means for urging said pusher element upwardly upon closing of said door panel.

8. An article display apparatus comprising:

a support having an elongated column connected to a base portion;

a housing mounted to said elongated column of said support, said housing having a hollow interior defined by transparent outer wall means formed with an article access opening;

an article support carriage mounted to said base support beneath said housing, said article support carriage having a plurality of spaced article supports each adapted to support articles in vertical columns within said hollow interior of said housing, said article supports being pivotal between an article support position and an article removal position;

a door assembly mounted to said outer wall means of said housing at said article access opening therein, said door assembly comprising:

(i) a door panel movable between an open position for permitting removal of articles from said housing through said article access opening therein, and a closed position in which said article access opening is closed, said door panel being formed with a cam surface;

(ii) a column support arm having a gripper element, said column support arm being movable between a retracted position spaced from said vertical columns of articles and a support position in which said gripper element contacts the article immediately above the lowermost article in said vertical column to retain the remaining articles in position in said vertical column;

(iii) pivot means mounted in operative engagement with said column support arm and said cam surface of said door panel, said pivot means being movable relative to said cam surface in a first direction to urge said column support arm into said support position in response to opening of said door panel, said pivot means being movable relative to said cam surface in a second direction to urge said column support arm into said retracted postion in response to closing of said door panel;

(iv) pusher means operatively connected to said door panel for pivoting said article supports to said article support position upon closing said door panel and for pivoting said article supports to said article removal position upon opening said door panel;

cooling means for cooling said hollow interior of said housing;

a basket rotatably mounted to said elongated column and movable atop said base portion of said support.

9. The article display apparatus of claim 8 in which said basket comprises:

first and second basket sections each formed of a plurality of transversely oriented, interconnected wires defining a bottom wall, an upright outer wall and an upright, semicircular-shaped inner wall;

means for rotatably mounting said first and second basket sections to said support so that said semicircular-shaped inner walls of said first and second basket sections are interconnected about said column of said support and said bottom walls of said first and second sections rest atop said base portion of said support, said first and second basket sections being rotatable relative to said column and said base portion of said support.

10. The article display apparatus of claim 9 in which said bottom wall of each said first and second basket sections includes rollers movable atop said base portion of said support.

11. An enclosure for refrigerating articles, comprising:

a housing having an outer wall defining a hollow interior for receiving articles to be refrigerated;

a thermally conductive column mounted within said hollow interior of said housing, said column being formed with an internal passageway having an inlet and an outlet;

thermally conductive coil means mounted to said column, said coil means having a first end proximate said inlet of said internal passageway of said column and a second end proximate said outlet of said internal passageway;

compressor means connected to said first end of said coil means for pumping cooling fluid in liquid phase into said coil means, said cooling fluid being converted from liquid phase into gaseous phase upon entering said coil means and moving toward said outlet of said column in gaseous phase to cool said coil means and said column, the cooling fluid creating a temperature gradient in said coil means and said column wherein said first end of said coil means proximate said inlet of said column is colder than said second end of said coil means proximate said outlet of said column;

blower means for circulating air in a direction from the relatively warmer, second end of said coil means to the relatively colder, first end of said coil means, the air being circulated into said inlet of said column, through said internal passageway, out said outlet of said column and into said hollow interior of said housing for refrigerating articles therein.

12. An article display apparatus, comprising:

a base support including a thermally conductive column formed with an internal passageway having an inlet and an outlet;

a housing having an outer wall defining a hollow interior, said housing being mounted to said column so that said internal passageway of said column is located within said hollow interior of said housing;

an article support carriage mounted to said base support for supporting articles within said hollow interior of said housing;

door means mounted to said housing for permitting removal of articles from said interior of said housing;

cooling means for refrigerating articles within said interior of said housing comprising:

(i) thermally conductive coil means mounted to said column, said coil means having a first end proximate said inlet of said internal passageway of said column and a second end proximate said outlet of said internal passageway;

(ii) compressor means connected to said first end of said coil means for pumping cooling fluid in liquid phase into said coil means, said cooling fluid being converted from liquid phase into gaseous phase upon entering said coil means and moving toward said outlet of said column in gaseous phase to cool said coil means and said column, the cooling fluid creating a temperature gradient in said coil means and said column wherein said first end of said coil means proximate said inlet of said column is colder than said second end of said coil means proximate said outlet of said column; and (iii) blower means for circulating air in a direction from the relatively warmer, second end of said coil means to the relatively colder, first end of said coil means, the air being circulated into said inlet of said column, through said internal passageway, out said outlet of said column and into said hollow interior of said housing for refrigerating articles therein.

13. Apparatus for refrigerating articles contained in the interior of a housing comprising:

a cooling coil having a first end and a second end spaced from said first end, said cooling coil being mounted within the interior of the housing so that articles carried within the housing are located between said first and second ends of said cooling coil;

means for converting a cooling fluid introduced into said cooling coil from liquid phase to gaseous phase;

means for circulating the cooling fluid in gaseous phase from said first end of said cooling coil to said second end thereof for cooling said cooling coil, the cooling fluid creating a temperature gradient in said cooling coil wherein said first end of said cooling coil is colder than said second end of said cooling coil;

means for circulating air in heat exchange relationship relative to said cooling coil and the articles contained in the interior of the housing in a direction from said warmer second end of said cooling coil, over articles located proximate said warmer second end and thereafter over articles located proximate said first, colder end of said cooling coil, the air proximate said warmer second end of said cooling coil being circulated toward said colder first end of said cooling coil to prevent freezing of the articles located proximate said colder first end and to provide a more uniform temperature of all articles located between said first and second ends of said cooling coil.

14. A method of refrigerating articles carried within the interior of a housing, comprising:

converting a cooling fluid introduced into a cooling coil from liquid phase to gaseous phase;

circulating the cooling fluid in gaseous phase from a first end of said cooling coil to a second end of said cooling coil for cooling said cooling coil, the cooling fluid creating a temperature gradient in said cooling coil wherein said first end of said cooling coil is colder than said second end of said cooling coil; and circulating air within said hollow interior of said housing in heat exchange relationship relative to said cooling coil in a direction from said relatively warmer second end of said cooling coil over articles located proximate said warmer second end thereafter over articles located proximate said first, colder end of said cooling coil, the air proximate said warmer second end of said cooling coil being circulated toward said colder first end of said cooling coil to prevent freezing of the articles located proximate said colder first end and to provide a more uniform temperature of all articles located between said first and second ends of said cooling coil.

15. A method of claim 13 including the further step of introducing the cooling fluid in liquid phase into said first end of said cooling coil.

16. A method of refrigerating articles supported end-to-end in vertical columns within the hollow interior of a housing of an article display apparatus, comprising:

positioning a cooling coil having spaced first and second ends within the hollow interior of an article display apparatus so that said second end is vertically above said first end, the articles carried in vertical columns within said hollow interior of said article display apparatus being located vertically between said first and second ends of said cooling coil;

introducing a cooling fluid in liquid phase into said first end of said cooling coil;

converting the cooling fluid from liquid phase to gaseous phase upon entering said first end of said cooling coil;

transmitting the cooling fluid in gaseous phase to said second end of said cooling coil, the cooling fluid creating a temperature gradient in said cooling coil wherein said first end is colder than said second end; and circulating air within said hollow interior of said housing in heat exchange relationship relative to said cooling coil and the articles supported in vertical columns therein in a direction from said relatively warmer second end of said cooling coil over articles located proximate said warmer second end and thereafter over articles located proximate said first, colder end of said cooling coil, the air proximate said warmer second end of said cooling coil being circulated toward said colder first end of said cooling coil to prevent freezing of the articles located proximate said colder first end and to provide a more uniform temperature of all articles located between said first and second ends of said cooling coil.

* * * * *

UNITED STATES PATENT AND TRADEMARK OFFICE

CERTIFICATE OF CORRECTION

PATENT NO. : 4,794,764

DATED : January 3, 1989

INVENTOR(S) : James A. Dyment et al

It is certified that error appears in the above-identified patent and that said Letters Patent is hereby corrected as shown below:

Column 3, line 12, "tha" should be --that--.

Column 4, line 60, "saem" should be --same--.

Column 11, line 32, "254" should be --154--.

Column 14, line 21, after "blower" insert --182 connected by a support 179 to the blower --.

Column 19, line 3, "postion" should be --position--.

Signed and Sealed this

Twenty-second Day of August, 1989

*Attest:*

DONALD J. QUIGG

*Attesting Officer*

*Commissioner of Patents and Trademarks*